US008471448B2

(12) United States Patent
Katsuraya et al.

(10) Patent No.: US 8,471,448 B2
(45) Date of Patent: Jun. 25, 2013

(54) HIGH-FREQUENCY PLASMA SPARK PLUG

(75) Inventors: Kohei Katsuraya, Aichi-ken (JP); Tatsunori Yamada, Aichi-ken (JP); Katsutoshi Nakayama, Aichi-ken (JP)

(73) Assignee: NGK Spark Plug Co., Ltd., Aichi (JP)

( * ) Notice: Subject to any disclaimer, the term of this patent is extended or adjusted under 35 U.S.C. 154(b) by 78 days.

(21) Appl. No.: 13/198,065

(22) Filed: Aug. 4, 2011

(65) Prior Publication Data

US 2012/0126681 A1 May 24, 2012

(30) Foreign Application Priority Data

Aug. 17, 2010 (JP) ..... 2010-182008
Jul. 7, 2011 (JP) ..... 2011-150526

(51) Int. Cl.
*H01T 13/04* (2006.01)

(52) U.S. Cl.
USPC ..... 313/118; 313/143; 313/141

(58) Field of Classification Search
USPC ..... 313/118, 140–145; 447/7; 219/121.64
See application file for complete search history.

(56) References Cited

U.S. PATENT DOCUMENTS 3,934,566 A 1/1976 Ward
4,138,980 A 2/1979 Ward

FOREIGN PATENT DOCUMENTS

JP 51-77719 7/1976
JP 2006-236906 9/2006
WO WO 2010043542 4/2010
WO WO 2010043543 4/2010

OTHER PUBLICATIONS

International Search Report for PCT/JP2009/071427.

*Primary Examiner* — Anh Mai
*Assistant Examiner* — Elmito Breval
(74) *Attorney, Agent, or Firm* — Greenblum & Bernstein, P.L.C.

(57) ABSTRACT

High-frequency plasma spark plug includes an insulator which has an axial hole extending in the axis direction, a center electrode inserted into a distal end side of the axial hole, a terminal electrode inserted into a rear end side of the axial hole, and being electrically connected to the center electrode, and a cylindrical main fitting mounted on an outer periphery of the insulator. With respect to a coaxial cable, the inner conductor is connected to the terminal electrode and the outer conductor is connected to the main fitting. High frequency power generated by a predetermined high-frequency power source is supplied via the coaxial cable thus generating high frequency plasma. The main fitting includes a large diameter portion which bulges radially outward and a connection portion which is brought into contact with the outer conductor.

15 Claims, 11 Drawing Sheets

HIGH-FREQUENCY PLASMA SPARK PLUG

TECHNICAL FIELD

The present invention relates to a high-frequency plasma spark plug which is used for an internal combustion engine or the like, and generates high-frequency plasma by high frequency power.

BACKGROUND ART

A spark plug used in a combustion device such as an internal combustion engine includes, for example, a center electrode which extends in the axial direction, an insulator which is formed on an outer periphery of the center electrode, a cylindrical main fitting which is assembled to an outer side of the insulator, and an earthed electrode which has a proximal end portion thereof jointed to a distal end portion of the main fitting. By applying a high voltage to the center electrode, a spark discharge is generated in a gap formed between the center electrode and the earthed electrode so that a fuel gas is ignited as a result.

Further, to enhance the ignitability, there has been proposed a high-frequency plasma spark plug (hereinafter also simply referred to as "spark plug") which ignites a fuel gas by generating high-frequency plasma with the supply of high frequency power in place of a high voltage to the gap. In transmitting high frequency power to the spark plug, a coaxial cable provided with an inner conductor and a cylindrical outer conductor which covers an outer periphery of the inner conductor is used. The coaxial cable is used for preventing the reflection of electricity and the radiation of electromagnetic wave noises to the outside and for more reliably transmitting high frequency power to the spark plug.

In connecting the spark plug and the coaxial cable to each other, an end portion of the inner conductor is connected to a terminal electrode, and an end portion of the outer conductor is connected to the main fitting which is earthed by being in contact with a combustion device (see Patent Document 1, for example).

PRIOR ART DOCUMENT

Patent Document

[Patent Document 1] JP-A-51-77719

SUMMARY OF THE INVENTION

Problems that the Invention is to Solve

Recently, a combustion device has been required to satisfy a higher output and the reduction of fuel consumption. Accordingly, the further enhancement of ignitability has been required for realizing the more reliable ignition of even a leaner air/fuel mixture than the maximum air/fuel mixture ratio of ignition. In view of the above, the inventors of the present invention have studied a contact position at which the main fitting and an end portion of the outer conductor are brought into contact with each other, wherein no particular study has been made with respect to such a contact portion. As a result of the study, it is found that the difference in the contact position largely influences the ignitability. Further, when we made further studies, it is clarified that a length of a portion of the main fitting to which the end portion of the outer conductor is connected is important in generating high-frequency plasma in a stable manner.

The present invention has been made under the above-mentioned circumstances, and it is an object of the present invention to provide a high-frequency plasma spark plug which may realize excellent ignitability and also may stably exhibit the excellent ignitability.

Means for Solving the Problem

The respective constitutions suitable for achieving the above-mentioned object are explained hereinafter by itemizing the paragraphs. When necessary, the particular manners of operation and advantageous effects corresponding to the respective constitutions are also explained additionally.

Constitution 1:

The high-frequency plasma spark plug having this constitution is a high-frequency plasma spark plug which includes:

an insulator which has an axial hole extending in the axial direction;

a center electrode which is inserted into a distal end side of the axial hole;

a terminal electrode which is inserted into a rear end side of the axial hole, and is electrically connected to the center electrode; and a cylindrical main fitting which is mounted on an outer periphery of the insulator, wherein with respect to a coaxial cable which has an inner conductor and a cylindrical outer conductor arranged on an outer periphery of the inner conductor, the inner conductor is connected to the terminal electrode and the outer conductor is connected to the main fitting, and high frequency power generated by a predetermined high-frequency power source is supplied via the coaxial cable thus generating high frequency plasma, wherein the main fitting includes:

a large diameter portion which bulges radially outward; and a connection portion which is brought into contact with the outer conductor, and the connection portion is formed closer to a rear end side in the axial direction than the large diameter portion, an outer periphery of the connection portion has a cylindrical shape which extends along the axial direction, and a length of the connection portion along the axis is set to not less than 0.5 mm and not more than 5 mm.

"high frequency power" is power having frequency of 3 MHz or more. Further, "coaxial cable" may be any cable in which a cylindrical outer conductor is arranged on an outer periphery of an inner conductor and, for example, may be a cable in which a metal-made pipe is arranged on an outer periphery of an inner conductor.

High frequency power has a property that the power flows along an outer surface of a conductor and hence, high frequency power flows along an inner peripheral surface and an outer peripheral surface of the main fitting. Due to the constitution 1, a conductive passage of high frequency power which flows routing around a rear end of the main fitting may be made relatively short. Accordingly, resistance in the conductive passage may be made relatively small and hence, power loss may be suppressed. As a result, the growth of high frequency plasma may be further enhanced thus realizing excellent ignitability.

Further, according to the above-mentioned constitution 1, the length of the connection portion along the axis is set sufficiently large, 0.5 mm or more. Accordingly, the vibration resistance may be enhanced and hence, even when vibrations brought about by an operation of a combustion device or the like is applied to a spark plug, it is possible to bring the connection portion and the outer conductor into contact with each other in a more stable state.

On the other hand, the length of the connection portion along the axis is set to not more than 5 mm and hence, it is possible to ensure a sufficiently large distance along a surface of the insulator between a rear end of the main fitting and the terminal electrode. Accordingly, it is possible to more reliably suppress the generation of abnormal discharge crawling a surface of the insulator between the main fitting and the terminal electrode (so-called flashover). As a result, it is possible to allow the high frequency plasma spark plug to exhibit the above-mentioned excellent ignitability in a stable manner along with the acquisition of stable contact between the connection portion and the outer conductor.

Constitution 2:

The high frequency plasma spark plug having this constitution is, in the above-mentioned constitution 1, characterized in that arithmetic average roughness Ra of a surface of the connection portion is set to not more than 10 μm.

Due to the constitution 2, contact resistance between the outer conductor and the connection portion may be decreased. As a result, the high frequency plasma spark plug may exhibit the excellent ignitability in a further stable manner.

Constitution 3:

The high frequency plasma spark plug having this constitution is, in the above-mentioned constitution 1 or 2, characterized in that, on the outer periphery of the connection portion, a male threaded portion with which a female threaded portion formed on an inner peripheral surface of the outer conductor is threadedly engageable is formed.

Due to the constitution 3, the connection portion and the outer conductor are joined to each other by thread engagement and hence, both parts may be connected to each other in a more reliable manner. Accordingly, the vibration resistance may be enhanced more and hence, the high frequency plasma spark plug may exhibit the excellent ignitability in a further stable manner.

Constitution 4:

The high frequency plasma spark plug having this constitution is, in the above-mentioned constitution 3, characterized in that the main fitting includes a loosening prevention means which prevents loosening of the female threaded portion relative to the male threaded portion.

As "loosening prevention means", for example, it may be possible to name a means which restricts the rotation of the outer conductor relative to the main fitting due to a frictional force such as a ring washer, a gasket or a metal O-ring which is constituted deformable by collapse between an end surface of a portion of the main fitting positioned on an intermediate distal end side of a connection portion (for example, a tool engaging portion or a large-diameter portion) and an end portion of a coaxial cable when the coaxial cable is mounted.

Due to the constitution 4, loosening of the outer conductor relative to the main fitting may be prevented by the loosening prevention means. Accordingly, the vibration resistance may be further enhanced and hence, the high frequency plasma spark plug may exhibit the excellent ignitability in a further stable manner.

Constitution 5:

The high frequency plasma spark plug having this constitution is, in any one of the above-mentioned constitutions 1 to 4, characterized in that a wall thickness of the connection portion is set to not less than 0.3 mm.

Although a stress is applied to the connection portion due to the vibrations of the outer conductor brought about by an operation of a combustion device, according to the above-mentioned constitution 5, the connection portion has a sufficiently large wall thickness and hence, it is possible to prevent breaking of the connection portion due to a stress in a more reliable manner. As a result, the high frequency plasma spark plug may exhibit the excellent ignitability in a more reliable manner.

Constitution 6:

The high frequency plasma spark plug having this constitution is, in any one of the above-mentioned constitutions 1 to 5, characterized in that a surface of the connection portion is coated with a film made of a material having higher conductivity than a material forming the main fitting.

According to the above-mentioned constitution 6, the film made of the material having higher conductivity than the material forming the main fitting is formed on the surface of the connection portion. Accordingly, in a conductive passage of high frequency power which flows along the surface of the main fitting, a resistance value of the path may be further decreased and hence, power loss may be further suppressed. As a result, the further enhancement of ignitability may be realized.

BRIEF DESCRIPTION OF THE DRAWINGS

FIG. 3 is a partially enlarged cross-sectional view showing the constitution of the connection portion and the like;

MODE FOR CARRYING OUT THE INVENTION

Embodiments of the present invention are explained in conjunction with drawings hereinafter.

First Embodiment

Figure 1:
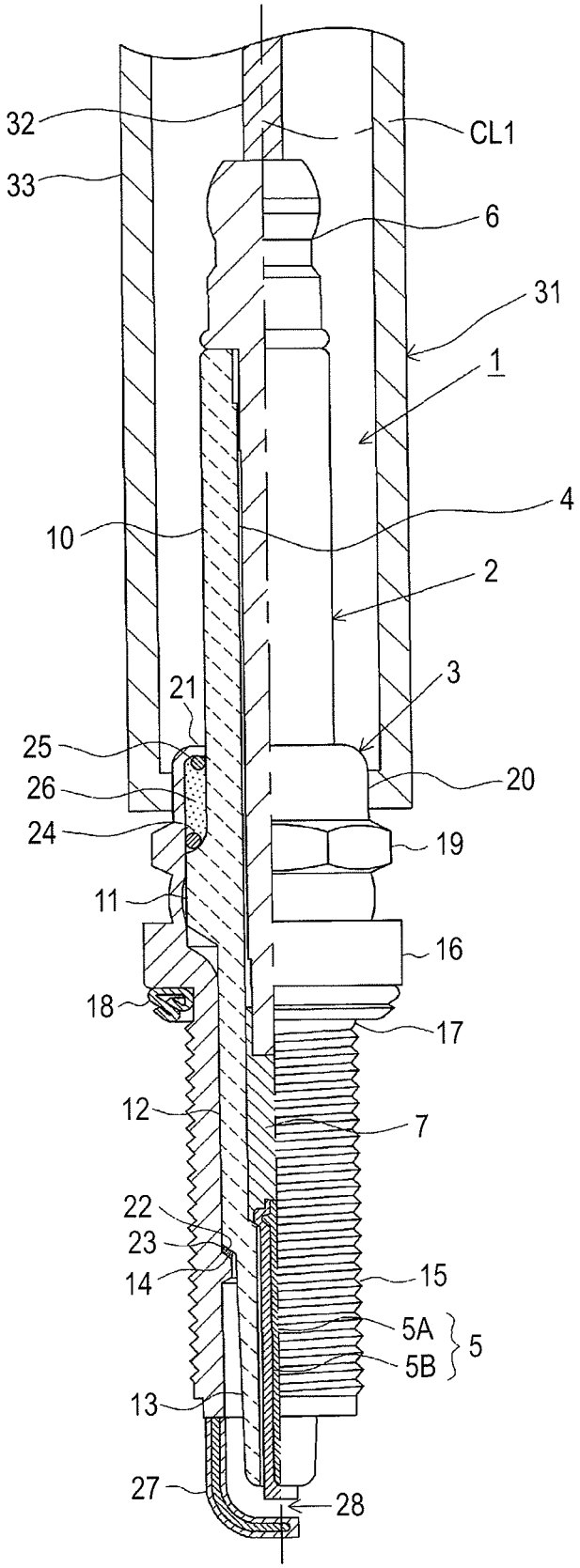
FIG. 1 is a front view showing the constitution of a spark plug with a part broken away.

FIG. 1 is a front view, with a part broken away, showing a high frequency plasma spark plug (hereinafter referred to as "spark plug") 1 and the like which generate high frequency plasma with the supply of high frequency power. In FIG. 1, the explanation is made by setting the axis CL1 direction of the spark plug 1 to the up-and-down direction, a distal end side of the spark plug 1 to a down side, and a rear end side of the spark plug 1 to an upper side in the drawing.

The spark plug 1 is constituted of an insulator 2 which constitutes an insulator, a cylindrical main fitting 3 which holds the insulator 2 and the like.

The insulator 2 is, as well known, formed by baking alumina or the like. The insulator 2 includes, as a profile portion, a rear-end-side barrel portion 10 formed on a rear end side thereof, an enlarged diameter portion 11 which is formed closer to a distal end side than the rear-end-side barrel portion 10 in a radially outwardly projecting manner, an intermediate barrel portion 12 which is formed closer to a distal end side than the enlarged diameter portion 11 and has a narrower diameter than the enlarged diameter portion 11, and an elongated leg portion 13 which is formed closer to a distal end side than the intermediate barrel portion 12 and has a narrower diameter than the intermediate barrel portion 12. With respect to such an insulator 2, the enlarged diameter portion 11, the intermediate barrel portion 12 and the most of the elongated leg portion 13 are housed in the inside of the main fitting 3. A tapered stepped portion 14 is formed in a connection portion between the intermediate barrel portion 12 and the elongated leg portion 13, and the insulator 2 is engaged with the main fitting 3 at the stepped portion 14.

Further, an axial hole 4 is formed in the insulator 2 in a penetrating manner along an axis CL1, and a center electrode 5 is inserted into and fixed to a distal end side of the axial hole 4. The center electrode 5 is formed of an inner layer 5A made of copper or a copper alloy, and an outer layer 5B made of an Ni-alloy containing nickel (Ni) as a main component. In addition, the center electrode 5 has a rod-like shape (a columnar shape) as a whole, wherein a distal end surface of the center electrode 5 is formed flat and projects from a distal end of the insulator 2.

Further, a terminal electrode 6 is inserted into and fixed to a rear end side of the axial hole 4 in a state where the terminal electrode 6 projects from a rear end of the insulator 2.

A conductive glass sealed layer 7 is arranged in the axial hole 4 between the center electrode 5 and the terminal electrode 6. The center electrode 5 and the terminal electrode 6 are electrically connected with each other by the glass sealed layer 7 and both electrodes 5, 6 are fixed to the insulator 2 by the glass sealed layer 7.

The main fitting 3 is made of metal such as carbon steel and is formed into a cylindrical shape. A threaded portion 15 is formed on an outer peripheral surface of the main fitting 3 for mounting the spark plug 1 on a combustion device such as an internal combustion engine or a fuel cell reformer. A flange-shaped large-diameter portion 16 which projects radially outward is formed on an outer peripheral surface of a rear end side of the threaded portion 15, and a ring-shaped gasket 18 is fitted on a threaded neck 17 at a rear end of the threaded portion 15. When the spark plug 1 is mounted on the combustion device, the large-diameter portion 16 is bought into indirect contact with the combustion device by way of the gasket 18 so that the main fitting 3 is eventually earthed. Further, on a rear end side of the main fitting 3, a tool engaging portion 19 having a hexagonal cross-sectional shape with which a tool such as a wrench is engaged in mounting the spark plug 1 on the combustion device is mounted. Further, a caulking portion 21 which is formed by bending radially inward is formed on a rear end side of the tool engaging portion 19, and the insulator 2 is held by the caulking portion 21. The large-diameter portion 16 may be brought into direct contact with the combustion device without providing the gasket 18.

A tapered stepped portion 22 for engagement with the insulator 2 is formed on an inner peripheral surface of the main fitting 3. The insulator 2 is fixed to the main fitting 3 in such a manner that the insulator 2 is inserted into the main fitting 3 toward a distal end side from a rear end side of the main fitting 3 and, in a state where the stepped portion 14 of the insulator 2 is engaged with the stepped portion 22 of the main fitting 3, an opening portion of a rear end side of the main fitting 3 is caulked radially inward, that is, the caulking portion 21 is formed. A circular annular sheet packing 23 is interposed between the stepped portion 14 of the insulator 2 and the stepped portion 22 of the main fitting 3. Due to such a constitution, gas tightness of the inside of a combustion chamber is secured and hence, a fuel gas which enters a gap between the elongated leg portion 13 of the insulator 2 exposed to the inside of the combustion chamber and an inner peripheral surface of the main fitting 3 is prevented from leaking to the outside.

To make the hermetic sealing by caulking more complete, on a rear end side of the main fitting 3, ring members 24, 25 are interposed between the main fitting 3 and the insulator 2, and talc 26 is filled between the ring members 24, 25. That is, the main fitting 3 holds the insulator 2 by way of the sheet packing 23, the ring members 24, 25 and the talc 26.

Further, to a distal end portion of the main fitting 3, an earthed electrode 27 which has an approximately intermediate portion thereof folded back and makes a side surface of a distal end portion thereof opposedly face a distal end surface of the center electrode 5 is joined. A gap 28 is formed between a distal end portion of the center electrode 5 and a distal end portion of the earthed electrode 27.

Further, in this embodiment, the spark plug 1 is configured such that high frequency power is supplied to the spark plug 1 via a coaxial cable 31 which includes an inner conductor 32 and a cylindrical outer conductor 33. The inner conductor 32 and the outer conductor 33 are formed using metal having excellent conductivity (for example, copper, gold, silver or an alloy which contains these components as a main component), and the outer conductor 33 is arranged on an outer periphery of the inner conductor 32 in a state where a distance in the radial direction between the outer conductor 33 and the inner conductor 32 is substantially held at a fixed value. Further, the inner conductor 32 is connected to a high frequency power source which generates high frequency power with frequency of not less than 3 MHz (not shown in the drawing), while the outer conductor 33 is earthed.

Figure 2:
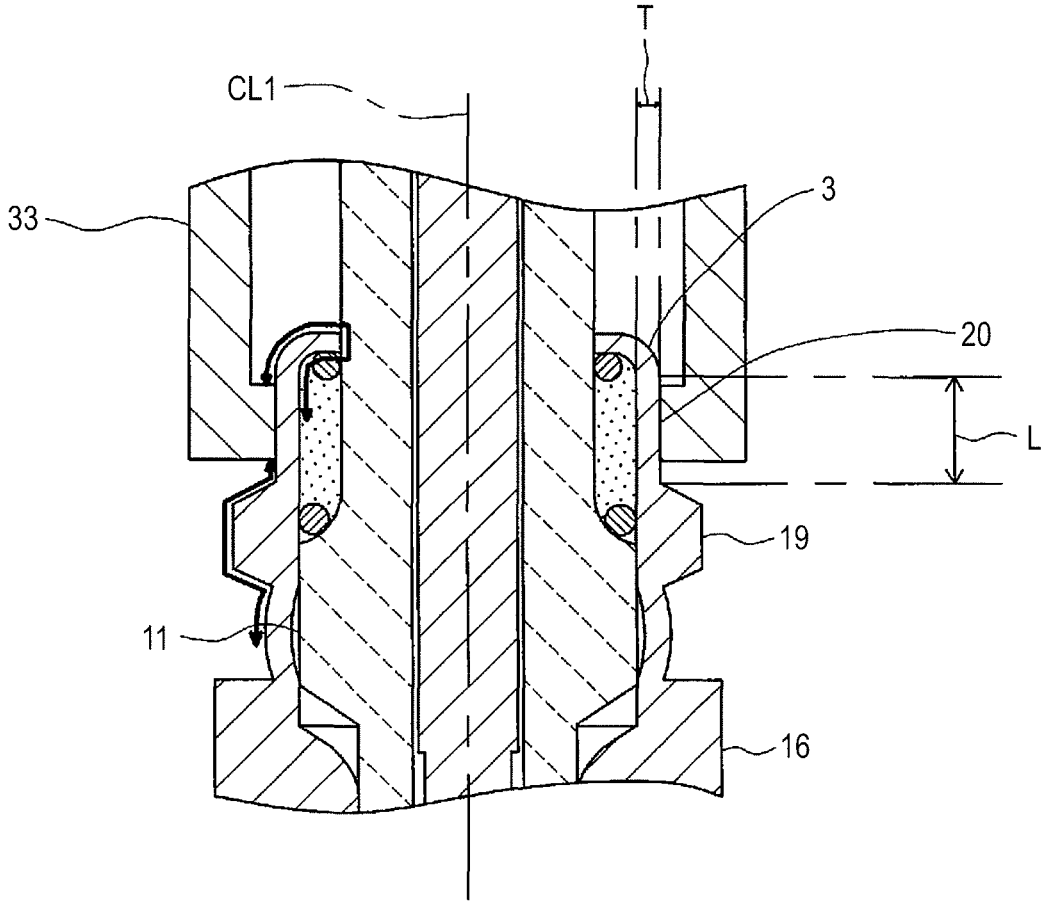
FIG. 2 is an enlarged cross-sectional view showing the constitution of a connection portion.

Further, in this embodiment, the main fitting 3 includes a cylindrical connection portion 20 which extends along the axis CL1 direction which is closer to a rear end side than the large-diameter portion 16 and which has an approximately same outer diameter as the large-diameter portion 16. The main fitting 3 and the outer conductor 33 are connected with each other by fitting the connection portion 20 into an end portion of the outer conductor 33, while an end portion of the inner conductor 32 is connected to the terminal electrode 6. In generating high frequency plasma, high frequency power is supplied to the terminal electrode 6 from the high frequency power source via the inner conductor 32. Accordingly, dielectric breakdown occurs between the earthed electrode 27 and the center electrode 5 and high frequency plasma is generated in the gap 28. High frequency power has a property that high frequency power flows along an outer surface of a conductor. Accordingly, as shown in FIG. 2 (an arrow in FIG. 2 schematically indicating the flow of high frequency power), high frequency power flows along an inner peripheral surface and an outer peripheral surface of the main fitting 3 between the earthed electrode 27 and the connection portion 20.

A length L of the connection portion 20 along the axis CL1 is set to not less than 0.5 mm and not more than 5 mm, and a wall thickness T of the connection portion 20 is set to not less than 0.3 mm.

Further, the arithmetic average roughness Ra of a surface of the connection portion 20 is set to not more than 10 pin.

Figure 3:
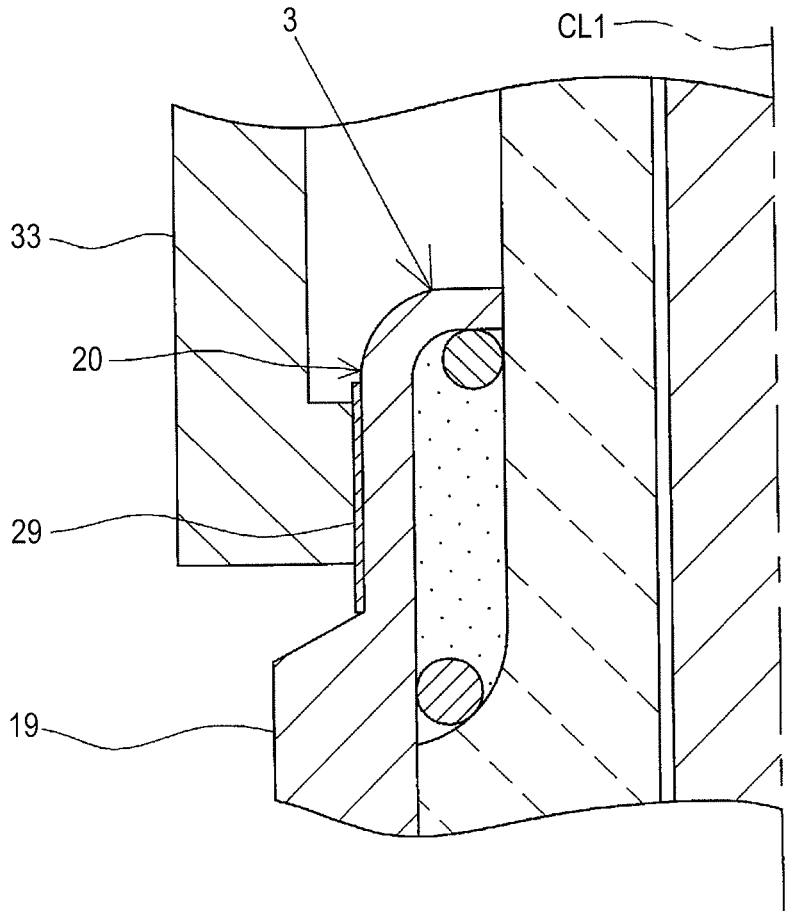

As shown in FIG. 3, for example, by plating, on a surface of the connection portion 20, a film 29 made of a material having higher conductivity than a material for forming the main fitting 3 (for example, silver (Ag), gold (Au), aluminum (Al), zinc (Zn), copper (Cu), an alloy which contains anyone of these components as a main component or the like) may be formed (In FIG. 3, for the sake of facilitating the understanding of drawing, a thickness of the film 29 being set larger than a usual thickness). When the film 29 is formed, it is preferable to set arithmetic average roughness Ra of a surface of the film 29 to not more than 10 μm.

As explained in detail, according to this embodiment, a conductive path of high frequency power which flows routing around the rear end of the main fitting 3 may be made relatively short and hence, resistance in the conductive passage may be made relatively small. Accordingly, power loss may be suppressed and hence, the high-frequency plasma spark plug of this embodiment may realize the excellent ignitability.

Further, the length L of the connection portion 20 along the axis CL1 is set sufficiently large, 0.5 mm or more and hence, even when vibrations brought about by an operation of a combustion device or the like is applied to the spark plug 1, it is possible to bring the connection portion 20 and the outer conductor 33 into contact with each other in a more stable state.

On the other hand, the length L of the connection portion 20 along the axis CL1 is set to not more than 5 mm and hence, it is possible to ensure a sufficiently large distance along a surface of the insulator 2 between a rear end of the main fitting 3 and the terminal electrode 6. Accordingly, it is possible to more reliably suppress the generation of flashover between the main fitting 3 and the terminal electrode 6 and hence, as described above, it is possible to allow the high frequency plasma spark plug to exhibit the excellent ignitability in a stable manner along with the acquisition of stable contact between the connection portion 20 and the outer conductor 33.

Further, the arithmetic average roughness Ra of the surface of the connection portion 20 is set to not more than 10 μm and hence, contact resistance between the outer conductor 33 and the connection portion 20 may be decreased. As a result, the high frequency plasma spark plug may exhibit the excellent ignitability in a further stable manner.

In addition, the wall thickness T of the connection portion 20 is set to not less than 0.3 mm and hence, it is possible to prevent breaking of the connection portion 20 due to a stress applied to the connection portion 20 from the outer conductor 33 in a more reliable manner. As a result, the high frequency plasma spark plug may exhibit the excellent ignitability in a more reliable manner.

Further, by applying the film 29, resistance value of a conductive passage of high frequency power transmitted along the surface of the main fitting 3 may be further decreased and hence, power loss may be further suppressed whereby the further enhancement of ignitability may be realized as a result.

Second Embodiment

Figure 4:
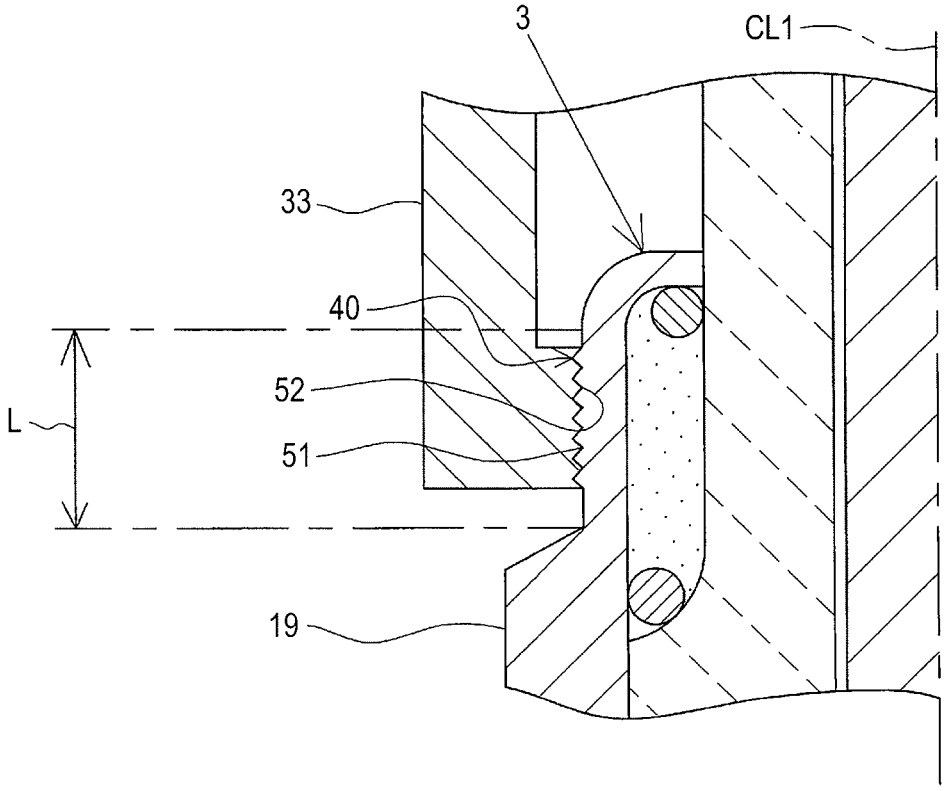
FIG. 4 is an enlarged cross-sectional view showing the constitution of a connection portion according to a second embodiment.

Next, the second embodiment is explained by focusing on the difference between the second embodiment and the first embodiment. Although the connection portion 20 is formed into a cylindrical shape with the smooth outer surface in the first embodiment, in the second embodiment, as shown in FIG. 4, a male threaded portion 51 is formed on an outer periphery of a connection portion 40. Due to the threaded engagement between the male threaded portion 51 and a female threaded portion 52 formed on an inner peripheral surface of an end portion of an outer conductor 33, the connection portion 40 and the outer conductor 33 are connected to each other. Also in the second embodiment, in the same manner as the above-mentioned first embodiment, the length L of the connection portion 40 along the axis CL1 is set to not less than 0.5 mm and not more than 5 mm.

As described above, the second embodiment of the present invention may basically acquire the substantially same manner of operation and advantageous effects as the above-mentioned first embodiment.

In addition, according to the second embodiment, the connection portion 40 and the outer conductor 33 are joined to each other by thread engagement and hence, both parts may be connected to each other more reliably. Accordingly, the vibration resistance may be enhanced more and hence, the high-frequency plasma spark plug of this embodiment may exhibit excellent ignitability in a more stable manner.

Figure 5:
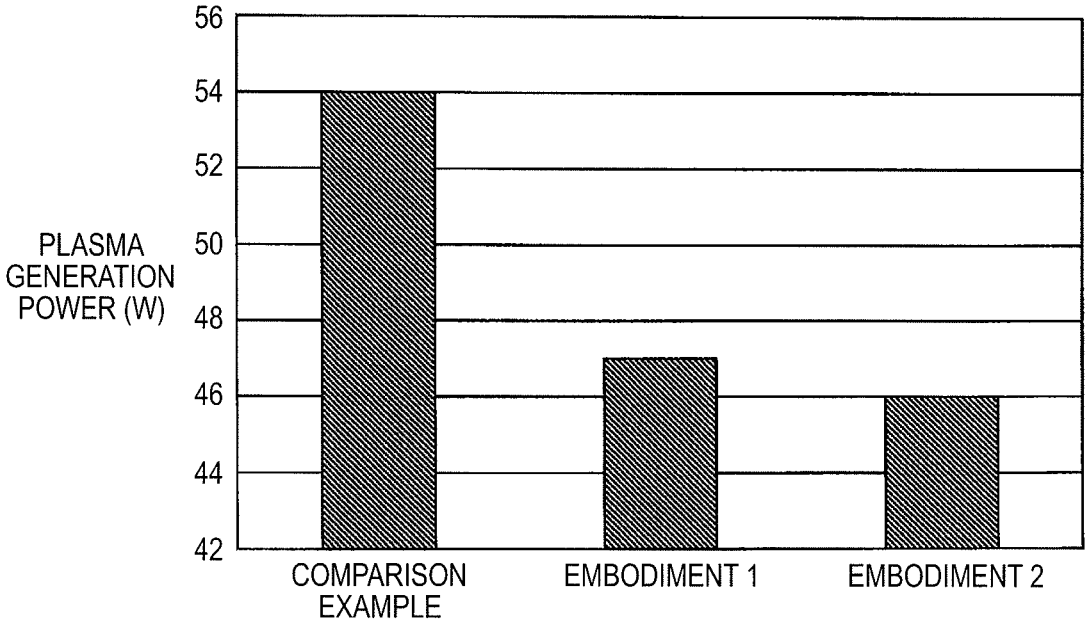
FIG. 5 is a graph showing a result of a plasma generating power measurement test in a case where a connection position of an outer conductor with respect to a main fitting is changed variously.

Next, to confirm the manner of operation and advantageous effects acquired by the above-mentioned embodiments, a plasma generating power measuring test is carried out with respect to a case where the outer conductor is connected to the large-diameter portion of the main fitting (comparison example), a case where the outer conductor is connected between the tool engaging portion and the caulking portion (embodiment 1) and a case where the outer conductor is connected to the caulking portion (embodiment 2). The summary of the plasma generating power test is as follows. That is, a sample of the spark plug is mounted in a predetermined chamber and a pressure in the chamber is set to 0.4 MPa and, thereafter, high frequency power is supplied to the sample from a predetermined high frequency power source, and power required for generating plasma (plasma generating power) is measured with respect to the above-mentioned respective cases. Here, it is reasonable to say that the smaller the plasma generating power, the smaller the power loss becomes so that the larger plasma may be generated (that is, ignitability becomes excellent) when the same power is supplied. FIG. 5 shows the result of the test. The main fitting is formed using carbon steel and a surface of the connection portion is not coated with a film.

Figure 6:
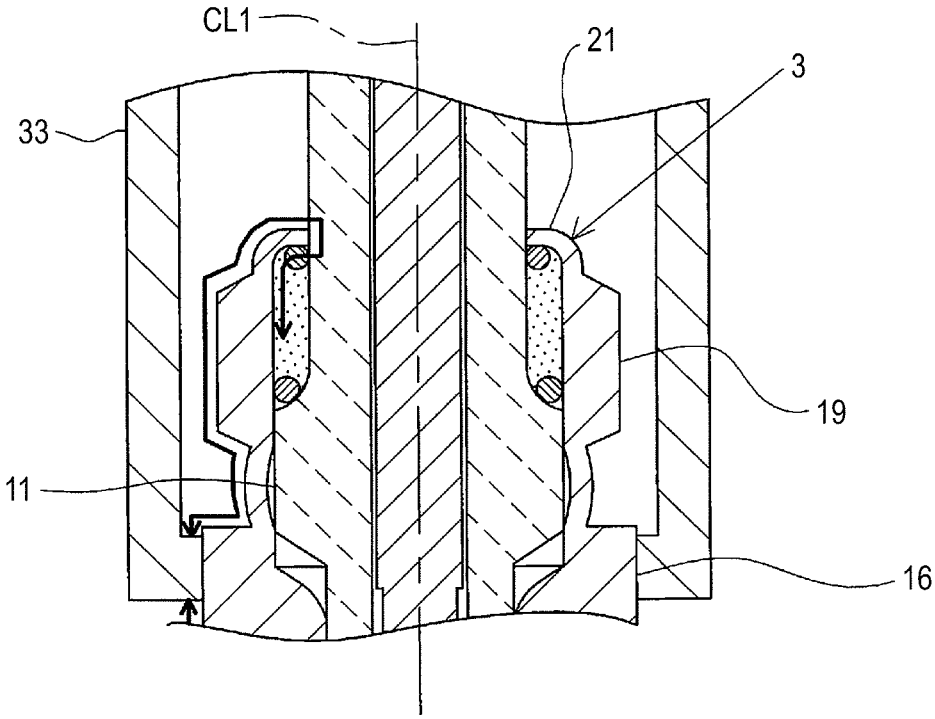
FIG. 6 is a cross-sectional schematic view schematically showing a path along which high frequency power flows in a comparison example.

As shown in FIG. 5, it is found that when the outer conductor is connected to the large-diameter portion, that is, when the large-diameter portion is used as the connection portion, plasma generating power becomes relatively large. The reason is thought that when high-frequency power flows along the outer peripheral surface and the inner peripheral surface of the main fitting, as shown in FIG. 6, the high-frequency power flows through a relatively long conductive passage routing around the caulking portion and hence, the power loss is increased.

To the contrary, it is found that when the outer conductor is connected between the tool engaging portion and the caulking portion or is connected to the caulking portion, that is, when the connection portion is provided closer to a rear end side than the large-diameter portion, the plasma generating power becomes sufficiently small so that the ignitability becomes excellent. The reason is thought that a conductive passage of high-frequency power along the surface of the main fitting becomes relatively short so that the power loss may be effectively suppressed.

From the above-mentioned test result, to suppress the power loss thus enhancing ignitability, it is reasonable to say that it is preferable to provide the connection portion closer to a rear end side than the large-diameter portion with respect to the main fitting.

Next, samples of spark plugs in which a connection portion is formed into a cylindrical shape while varying a length L of the connection portion along an axis, and samples of spark plugs in which a male threaded portion is formed on an outer periphery of the connection portion are prepared respectively, and the respective samples are subjected to a plasma generation confirmation test and a flashover resistance test.

The plasma generation confirmation testis summarized as follows. That is, each sample is connected to a coaxial cable in such a manner that in the samples in which the connection portion is formed into a cylindrical shape, the connection portion is fitted into an outer conductor, while in the samples in which the male threaded portion is formed on the connection portion the connection portion is threadedly engaged with a female threaded portion of an outer conductor. Then, each sample is subjected to an impact resistance test stipulated in JIS B8031 (test in which an impact with a vibration amplitude of 22 mm is applied to a spark plug for 10 minutes at a rate of 400 times per minute) and, thereafter, it is confirmed whether or not plasma is generated by supplying predetermined high-frequency power to each sample.

The flashover resistance test is summarized as follows. That is, each sample is mounted in a predetermined chamber and pressure in the chamber is set to 1.0 MPa. Then, it is confirmed whether or not abnormal discharge (flashover) transmitted along a surface of an insulator is generated between a terminal electrode and a main fitting when predetermined high frequency power is supplied to the sample.

With respect to the test result of the plasma generation confirmation test, the test result of the samples in which connection portion is formed into a cylindrical shape is shown in Table 1, and the test result of the samples in which the male threaded portion is formed on the outer periphery of the connection portion is shown in Table 2. Further, with respect to the test result of the flashover resistance test, the test result of the samples in which connection portion is formed into a cylindrical shape is shown in Table 3, and the test result of the samples in which the male threaded portion is formed on the outer periphery of the connection portion is shown in Table 4. In all respective samples, a size (diagonal size) of a tool engaging portion is set to 14 mm, and an outer diameter of a connection portion (diameter of threads) is set to 13 mm. Further, a length along an axis from a rear end of an insulator to a distal end of a large-diameter portion is set to a fixed length compatible to a standard such as JIS. A length of a portion of the connection portion which is brought into contact with an outer conductor is set smaller than L.

TABLE 1

| Connection portion: cylindrical shape | |
|---|---|
| Length L of connection portion (mm) | Evaluation on generation of plasma |
| 0.3 | bad |
| 0.5 | good |
| 0.7 | good |
| 1.0 | good |

TABLE 2

| Connection portion: male threaded portion | |
|---|---|
| Length L of connection portion (mm) | Evaluation on generation of plasma |
| 0.3 | bad |
| 0.5 | good |
| 0.7 | good |
| 1.0 | good |

TABLE 3

| Connection portion: cylindrical shape | |
|---|---|
| Length L of connection portion L (mm) | Evaluation on flashover resistance |
| 3 | good |
| 4 | good |
| 5 | good |
| 6 | bad |

TABLE 4

| Connection portion: male threaded portion | |
|---|---|
| Length L of connection portion L (mm) | Evaluation on flashover resistance |
| 3 | good |
| 4 | good |
| 5 | good |
| 6 | bad |

As shown in Table 1 and Table 2, with respect to the samples in which the length L of the connection portion is set to less than 0.5 mm, the generation of plasma is not confirmed so that it is found that the sample is inferior in terms of vibration resistance. The reason is thought that the length L of the connection portion is relatively short and hence, the outer conductor is removed from the connection portion due to vibrations.

As shown in Table 3 and Table 4, with respect to the sample in which the length L of the connection portion is set to more than 5 mm, the flashover is generated so that it is found that the generation of plasma is impeded. The reason is thought that the length L of the connection portion is increased and hence, the distance along a surface of the insulator between the main fitting and the terminal electrode becomes small whereby the insulation property between the main fitting and the terminal electrode is lowered.

To the contrary, with respect to the samples in which the length L of the connection portion is set to not less than 0.5 mm and not more than 5 mm, it is confirmed that the samples are excellent in both the vibration resistance and the flashover resistance. The reason is thought that by allowing the connection portion to secure the sufficiently large length L, a contact state between the connection portion and the outer conductor becomes stable even when vibrations are applied to the sample, while by preventing the length L from becoming excessively large, the insulation property between the main fitting and the terminal electrode may be sufficiently secured.

From the above-mentioned test result, it is reasonable to say that it is preferable to set the length L of the connection portion to not less than 0.5 mm and not more than 5 mm to realize the excellent vibration resistance and the excellent flashover resistance.

Next, samples of spark plugs in which a connection portion is formed into a cylindrical shape and surface roughness of a connection portion is changed variously are prepared, and each sample is subjected to an ignitability evaluation test. The ignitability evaluation test is summarized as follows. That is, the sample is assembled to one cylinder of a DOHC engine having the displacement of 2.0 L, high-frequency power of 100 W is supplied to the sample 1000 times, and a waveform of discharge voltage (discharge waveform) when high frequency power is supplied is measured. Then, the number of discharge abnormalities (misfires) generated for the supply of high frequency power of 1000 times is measured based on the discharge waveform and, at the same time, a rate that the misfire occurs (misfire rate) is calculated. Table 5 shows the relationship between the arithmetic average roughness of the surface of the connection portion and the misfire rate. In all samples, the length L of the connection portion is set to 0.5 mm.

TABLE 5

| Arithmetic average roughness Ra (μm) | Misfire rate (%) |
|---|---|
| 3 | 0 |
| 5 | 0 |
| 10 | 0 |
| 15 | 2 |

As shown in Table 5, the misfire does not occur in the samples in which the surface roughness of the connection portion is set to 10 μm or less so that it is found that plasma may be generated in a stable manner. The reason is thought that by making the surface of the connection portion smooth, the contact resistance between the connection portion and the outer conductor may be sufficiently decreased.

Based on the above-mentioned test result, from a viewpoint of generating plasma in a more stable manner, it is reasonable to say that it is preferable to set the arithmetic average roughness Ra of the surface of the connection portion to not more than 10 μm.

Next, samples of spark plugs in which a wall thickness T of a connection portion is changed variously are prepared, and each sample is subjected to the above-mentioned impact resistance test stipulated in the JIS B8031. Then, the connection portion is observed after the test, and the presence and the non-presence of cracks in the connection portion are confirmed. Table 6 shows the test result of the test. In all samples, the length L of the connection portion is set to 1.0 mm.

TABLE 6

| Wall thickness T of connection portion (mm) | Presence or non-presence of crack |
|---|---|
| 0.2 | crack present |
| 0.3 | no crack |
| 0.5 | no crack |
| 0.7 | no crack |

As shown in Table 6, it is found that the samples in which the wall thickness T of the connection portion is set to not less than 0.3 mm possess excellent strength without causing cracks in the connection portion.

From the above-mentioned test results, it is reasonable to say that it is preferable to set the wall thickness T of the connection portion to not less than 0.3 mm from a view point of enhancing strength against an impact and generating plasma in a more stable manner.

Next, samples of spark plugs in which a main fitting is formed using carbon steel and a surface of the connection portion is coated with a film made of Ag, Au, Al, Zn or Cu and samples of spark plugs in which no specific film is formed on a surface of the connection portion are prepared, and each sample is subjected to the above-mentioned plasma generating power measurement test. Table 7 shows the test result of the respective samples, and at the same time, metals which form a film (film forming metals) and conductivities of the film forming metals. With respect to the samples on which a film is not formed, conductivity of carbon steels is shown in a column of conductivity in Table 7.

TABLE 7

| Film forming metal | Conductivity ($\times 10^6$ s/m) | Plasma generating power (W) |
|---|---|---|
| no film coating | 5 | 47 |
| Ag | 62 | 40 |
| Au | 42 | 41 |
| Al | 36 | 42 |
| Zn | 14 | 43 |
| Cu | 58 | 40 |

As shown in Table 7, it is clarified that in the samples in which the film is formed on the surface of the connection portion using metal having higher conductivity than a material for constituting the main fitting, plasma generating power is decreased in each sample so that the sample is excellent in a power loss suppression effect. The reason is thought that by forming the film on the surface of the main fitting, the resistance of the surface of the main fitting may be lowered.

Based on the above-mentioned test result, from a viewpoint of further suppressing the power loss and further enhancing ignitability, it is reasonable to say that it is preferable to form the film made of metal having higher conductivity than the material which constitutes the main fitting on the surface of the connection portion.

The present invention is not limited to the contents described in the above-mentioned embodiments, and the present invention may be carried out as follows, for example. It is needless to say that the present invention is also applicable to other applications or modifications which are not exemplified hereinafter.

(a) The position where the connection portion 20 is formed in the main fitting 3 described in the above-mentioned embodiment is provided as an example, and the position where the connection portion 20 is formed may be any position provided that the position is closer to a rear end side than the large-diameter portion 16 along the axis CL1 direction.

Figure 7A:
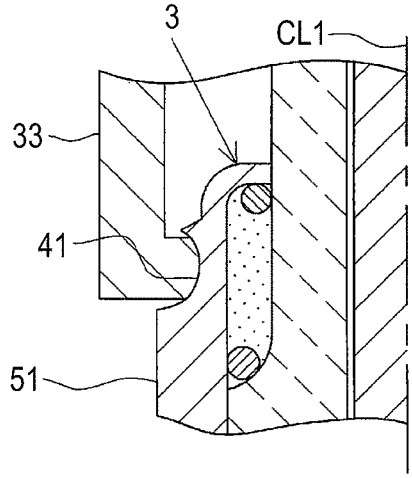
FIGS. 7A to 7C are enlarged cross-sectional views showing the constitution of a connection portion in another embodiment.
Figure 7B:
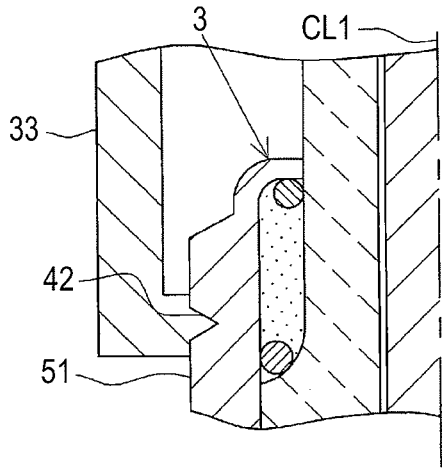
Figure 7C:
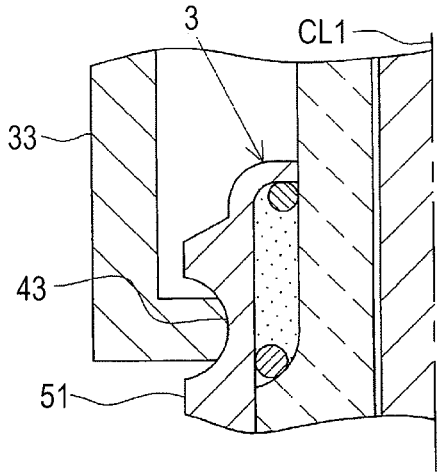

Accordingly, as shown in FIGS. 7A to 7C, an annular recessed connection portion 41, 42, 43 may be formed on an outer peripheral surface of a tool engaging portion 51. Also in these cases, the substantially same manner of operation and advantageous effects as the above-mentioned embodiment may be acquired. Further, by forming the connection portions 41 to 43 in a recessed shape, it is possible to surely prevent an end portion of the outer conductor 33 from moving along the axis CL1 direction relative to the connection portion 41, 42, 43 thus connecting the connection portion 41, 42, 43 and the outer conductor 33 to each other in a more stable state. A position where the connection portion is formed on the outer peripheral surface of the tool engaging portion 51 is not particularly limited. That is, the connection portion 41 may be formed on a rear end side of the tool engaging portion 51 as shown in FIG. 7A or the connection portion 42, 43 may be formed at the approximately center of the tool engaging portion 51 as shown in FIGS. 7B and 7C. Further, as shown in FIG. 7B, in a cross section which includes the axis CL1, a profile line of the connection portion 42 may be formed into a bent shape or, as shown in FIG. 7C, in a cross-section which includes the axis CL1, a profile line of the connection portion 43 may be formed into a curved shape.

Figure 8A:
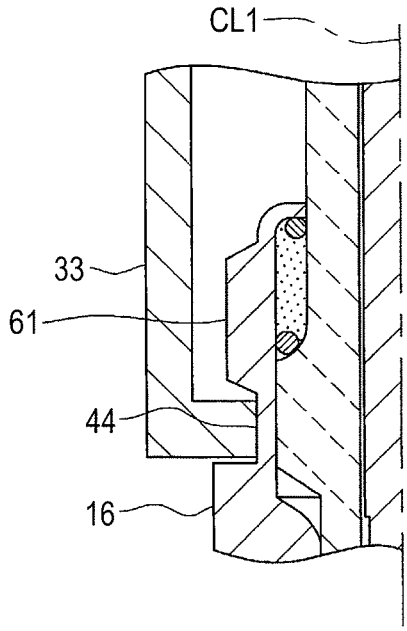
FIGS. 8A and 8B are enlarged cross-sectional views showing the constitution of a connection portion in another embodiment.
Figure 8B:
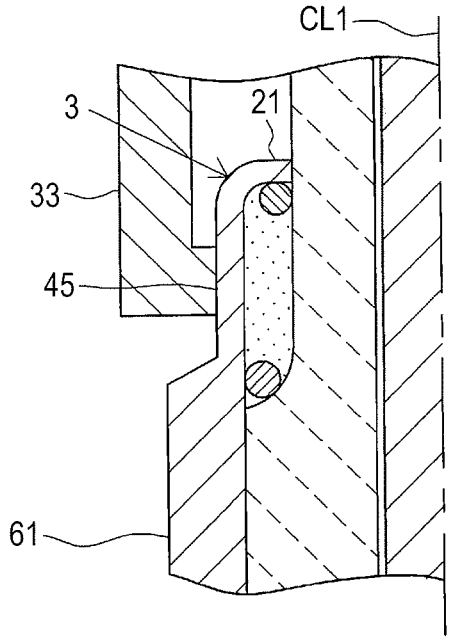

Further, in the above-mentioned embodiment, a length of the tool engaging portion 19 along the axis CL1 is set relatively short for forming the connection portion 20. However, the connection portion may be formed while maintaining the length of the tool engaging portion substantially equal to a conventional length of the tool engaging portion. Accordingly, for example, as shown in FIG. 8A, by forming the connection portion 44 using a relatively thin-wall portion of the main fitting 3 which is positioned between the tool engaging portion 61 and the large-diameter portion 16, it may be possible to maintain a sufficient length of the tool engaging portion 61. Further, as shown in FIG. 8B, a connection portion 45 may be formed between a tool engaging portion 61 and a caulking portion 21 while maintaining a sufficient length of the tool engaging portion 61.

Figure 9A:
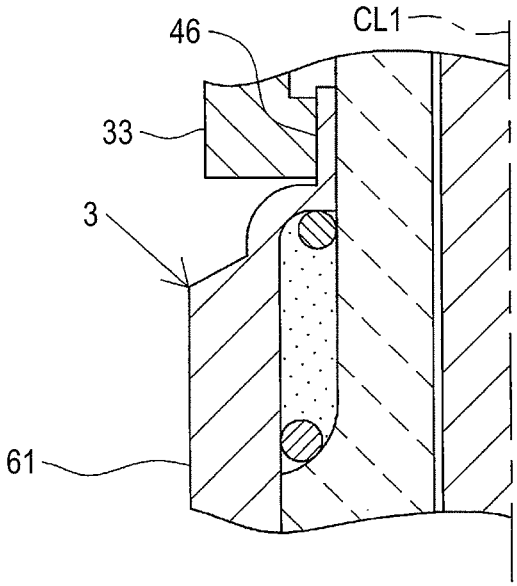
FIGS. 9A and 9B are enlarged cross-sectional views showing the constitution of a connection portion in another embodiment.
Figure 9B:
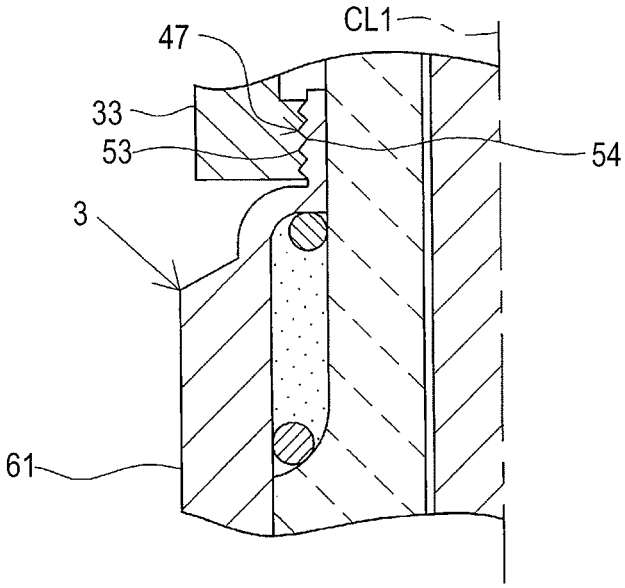

In addition, as shown in FIG. 9A, while ensuring a sufficient length of the tool engaging portion 61 along the axis CL1, a cylindrical connection portion 46 extending to a rear end side in the axis CL1 direction from a rear end of the caulking portion 21 may be formed. In this case, as shown in FIG. 9B, a male threaded portion 53 which is threadedly engageable with a female threaded portion 54 formed on an inner peripheral surface of an end portion of the outer conductor 33 may be formed on an outer periphery of the connection portion 47.

Figure 10:
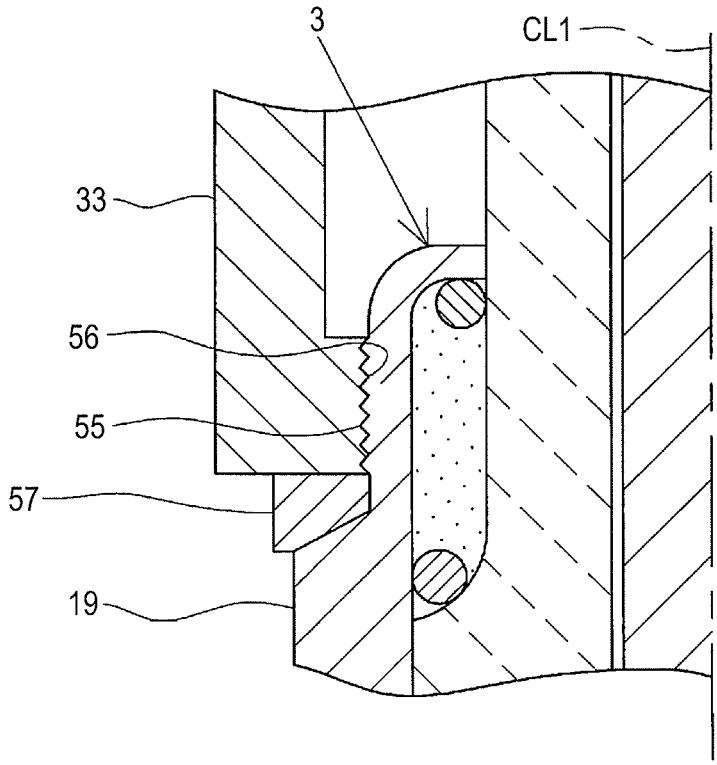
FIG. 10 is a partially enlarged cross-sectional view showing a spring washer and the like which constitutes a loosening prevention means.

(b) Although not particularly described in the above-mentioned embodiment, in connecting the connection portion and the outer conductor 33 by thread engagement, a loosening prevention means for preventing loosening of the female threaded portion relative to the male threaded portion may be formed. As the loosening prevention means, for example, as shown in FIG. 10, it is possible to name a spring washer 57 which, when the male threaded portion 55 is threadedly engaged with the female threaded portion 56, is brought into contact with an end surface of the outer conductor 33 and is deformed by collapsing. The rotation of the outer conductor 33 relative to the main fitting 3 may be restricted by the spring washer 57 so that loosening of the female threaded portion 56 relative to the male threaded portion 55 may be prevented. As the loosening prevention means, in place of the spring washer 57, for example, an annular gasket, a metal O ring or the like may be used.

Figure 11:
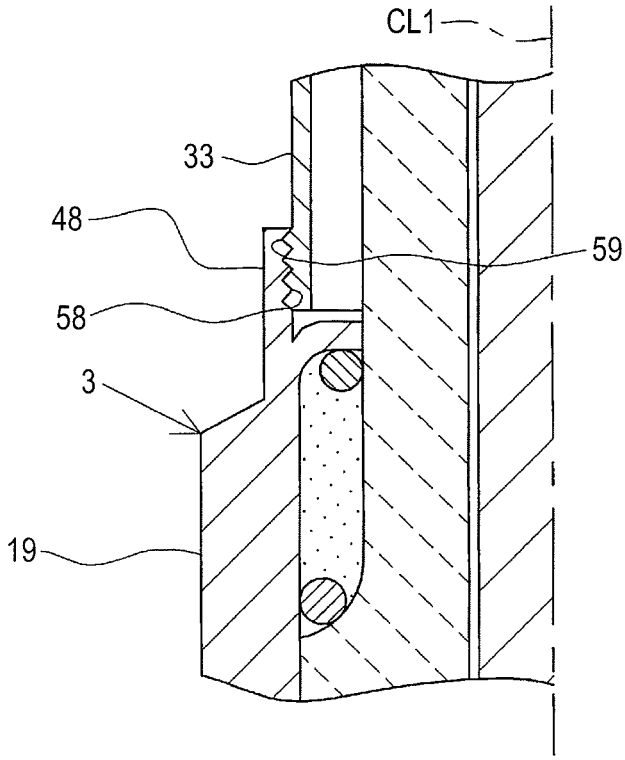
FIG. 11 is a partially enlarged cross-sectional view showing the constitution of a connection portion in another embodiment.

(c) In the above-mentioned embodiment, the case where the male threaded portion is formed on the outer peripheral surface of the connection portion is described. However, as shown in FIG. 11, the connection portion 48 and the outer conductor 33 may be connected in such a manner that a cylindrical connection portion 48 which is formed closer to a rear end side than the caulking portion 21 of the main fitting 3, a female threaded portion 58 is formed on an inner peripheral surface of the connection portion 48, and a male threaded portion 59 formed on an outer peripheral surface of an end portion of the outer conductor 33 is threadedly engaged with the female threaded portion 58. Also in this case, the connection portion 48 and the outer conductor 33 may be surely brought into contact with each other and hence, a power loss may be more surely suppressed. Further, the outer conductor 33 may be formed with a smaller diameter and hence, for example, even when a large space cannot be ensured around the outer periphery of the spark plug such as a spark plug arranged in the inside of a plug hole, the outer conductor 33 may be more easily and more surely connected to the connection portion 48.

(d) In the above-mentioned embodiment, the technique in which the film 29 is formed on the surface of the connection portion 20 by plating is described. However, the film 29 may be formed by adhering a tape formed using Cu, Ag or the like to a surface of the connection portion 20, for example.

(e) In the above-mentioned embodiment, the case where the earthed electrode 27 is joined to the distal end portion of the main fitting 3 is embodied. However, the present invention is also applicable to a case where an earthed electrode is formed by cutting a part of the main fitting (or a part of a distal end fitting which is welded to the main fitting preliminarily) (for example, JP-A-2006-236906 or the like).

(f) In the above-mentioned embodiment, the tool engaging portion 19 has a hexagonal cross section. However, a shape of the tool engaging portion 19 is not limited to such a shape. For example, the tool engaging portion 19 may be formed into a Bi-HEX (deformed 12 angular) shape (ISO22977:2005(E)) or the like.

DESCRIPTION OF REFERENCE NUMERALS AND SIGNS

| | |
|---|---|
| 1: | spark plug (high frequency plasma spark plug) |
| 2: | insulator (insulator) |
| 3: | main fitting |
| 4: | axial hole |
| 5: | center electrode |
| 6: | terminal electrode |
| 16: | large-diameter portion |
| 20: | connection portion |
| 29: | film |
| 31: | coaxial cable |
| 32: | inner conductor |
| 33: | outer conductor |
| 51: | male threaded portion |
| 52: | female threaded portion |
| 57: | spring washer (loosening prevention means) |
| CL1: | axis |

The invention claimed is:

1. A high-frequency plasma spark plug which includes:

an insulator which has an axial hole extending in the axis direction;

a center electrode which is inserted into a distal end side of the axial hole;

a terminal electrode which is inserted into a rear end side of the axial hole, and is electrically connected to the center electrode; and a cylindrical main fitting which is mounted on an outer periphery of the insulator, wherein with respect to a coaxial cable which has an inner conductor and a cylindrical outer conductor arranged on an outer periphery of the inner conductor, the inner conductor is connected to the terminal electrode and the outer conductor is connected to the main fitting, and high frequency power generated by a predetermined high-frequency power source is supplied via the coaxial cable thus generating high frequency plasma, wherein the main fitting comprises:

a large diameter portion which bulges radially outward; and a connection portion which is brought into contact with the outer conductor, and the connection portion is formed closer to a rear end side in the axis direction than the large diameter portion, an outer periphery of the connection portion has a cylindrical shape which extends along the axis direction, and a length of the connection portion along the axis is set to not less than 0.5 mm and not more than 5 mm.

2. The high frequency plasma spark plug according to claim 1, wherein arithmetic average roughness Ra of a surface of the connection portion is set to not more than 10 μm.

3. The high frequency plasma spark plug according to claim 2, wherein, on the outer periphery of the connection portion, a male threaded portion with which a female threaded portion formed on an inner peripheral surface of the outer conductor is threadedly engageable is formed.

4. The high frequency plasma spark plug according to claim 3, wherein the main fitting includes a loosening prevention means which prevents loosening of the female threaded portion relative to the male threaded portion.

5. The high frequency plasma spark plug according to claim 2, wherein a wall thickness of the connection portion is set to not less than 0.3 mm.

6. The high frequency plasma spark plug according to claim 2, wherein a surface of the connection portion is coated with a film made of a material having higher conductivity than a material forming the main fitting.

7. The high frequency plasma spark plug according to claim 1, wherein, on the outer periphery of the connection portion, a male threaded portion with which a female threaded portion formed on an inner peripheral surface of the outer conductor is threadedly engageable is formed.

8. The high frequency plasma spark plug according to claim 7, wherein a wall thickness of the connection portion is set to not less than 0.3 mm.

9. The high frequency plasma spark plug according to claim 7, wherein a surface of the connection portion is coated with a film made of a material having higher conductivity than a material forming the main fitting.

10. The high frequency plasma spark plug according to claim 7, wherein the main fitting includes a loosening prevention means which prevents loosening of the female threaded portion relative to the male threaded portion.

11. The high frequency plasma spark plug according to claim 10, wherein a wall thickness of the connection portion is set to not less than 0.3 mm.

12. The high frequency plasma spark plug according to claim 10, wherein a surface of the connection portion is coated with a film made of a material having higher conductivity than a material forming the main fitting.

13. The high frequency plasma spark plug according to claim 1, wherein a wall thickness of the connection portion is set to not less than 0.3 mm.

14. The high frequency plasma spark plug according to claim 13, wherein a surface of the connection portion is coated with a film made of a material having higher conductivity than a material forming the main fitting.

15. The high frequency plasma spark plug according to claim 1, wherein a surface of the connection portion is coated with a film made of a material having higher conductivity than a material forming the main fitting.

* * * * *